US005142652A

United States Patent [19]

Reichenberger et al.

[11] Patent Number: 5,142,652

[45] Date of Patent: Aug. 25, 1992

[54] X-RAY ARRANGEMENT COMPRISING AN X-RAY RADIATOR HAVING AN ELONGATED CATHODE

[75] Inventors: Helmut Reichenberger, Eckental; Gerhard Brandner, Zirndorf, both of Fed. Rep. of Germany

[73] Assignee: Siemens Aktiengesellschaft, Munich, Fed. Rep. of Germany

[21] Appl. No.: 738,900

[22] Filed: Aug. 1, 1991

[30] Foreign Application Priority Data

Jun. 28, 1991 [DE] Fed. Rep. of Germany ..... 4026299

[51] Int. Cl.[5] ..... H01J 35/06

[52] U.S. Cl. ..... 378/136; 378/125; 378/134

[58] Field of Search ..... 378/136, 138, 137, 134, 378/124, 146

[56] References Cited

U.S. PATENT DOCUMENTS 3,833,494 9/1974 Van Stratum et al. .
4,126,805 11/1978 Randall ..... 378/138
4,250,425 2/1981 Gabbay et al. ..... 378/137
4,340,816 7/1982 Schott .
4,349,740 9/1982 Grassmann et al. ..... 378/134
4,490,835 12/1984 Wons .
4,530,669 7/1985 Gartner et al. .
4,752,713 6/1988 Buxbaum .
5,029,195 7/1991 Danos ..... 378/138

FOREIGN PATENT DOCUMENTS 2034149 5/1980 United Kingdom .

*Primary Examiner*—Craig E. Church
*Attorney, Agent, or Firm*—Hill, Van Santen, Steadman & Simpson

[57] ABSTRACT

An x-ray radiator has an elongated cathode for emitting an electron beam having an elongated cross section, the electrons of the electron beam being accelerated onto an anode for generating x-radiation. The cathode is formed by a geometrical member completely filled with electron-emitting material, and the material of the cathode contains at least one element from the group of rare earths and at least one element from the group of precious metals or boron.

13 Claims, 2 Drawing Sheets

X-RAY ARRANGEMENT COMPRISING AN X-RAY RADIATOR HAVING AN ELONGATED CATHODE

BACKGROUND OF THE INVENTION

1. Field of the Invention

The present invention relates to an apparatus for generating x-rays, and in particular to an x-ray radiator having an elongated cathode.

2. Description of the Prior Art

U.S. Pat. No. 4,340,816 discloses a radiation source having an anode which is either elongated or arcuately curved, arranged opposite a plurality of cathodes. These cathodes can be individually driven in succession for the emission of electrons. The electrons can then be accelerated onto the anode as an electron beam for generating a ray bundle. The ray bundle that is generated is thereby conically fashioned. The individual, successively generated, conical ray bundles penetrate an exposure subject and are incident on a radiation receiver that is synchronously driven in a direction opposite the drive of the cathodes. A grating can be provided between the anode and each of the individual cathodes, the emission of electrons of each individual cathode being capable of being controlled with its associated grating.

U.S. Pat. No. 4,490,835 discloses an x-ray examination apparatus having an x-ray tube which generates an x-ray beam which is gated to form a thin rectangular ray fan by a focus-proximate primary radiation diaphragm. This ray fan penetrates an exposure subject and subsequently penetrates a further slot-shaped gating apparatus before it is incident on an image layer carrier. The primary radiation diaphragm and the gating mechanism are aligned relative to one another such that they are adjustable uniformly and in a fixed relationship relative to one another above the image layer carrier for preparing an x-ray exposure of a subject. This x-ray examination apparatus allows x-ray exposures to be produced that have a low proportion of scattered rays. This is desirable since the scattered radiation contains no information about the exposure subject and deteriorates the x-ray exposure.

A large part of the useful x-ray cone of the x-ray tube is blanked by the focus-proximate primary radiation diaphragm, so that only a slight part contributes to the generated x-ray for imaging. The x-ray tube is thus highly stressed in order to provide the x-ray dose needed for producing an x-ray exposure.

British Patent No. 949 312 discloses a cathode of an x-ray tube for generating a uniform and elongated electron emission on the anode. To this end, this cathode comprises an elongated, uncoiled glow wire that is convexly arcuately shaped opposite the propagation direction of the electrons. A metallic shielding having a slot that accepts the glow wire is provided, whereby the front surfaces thereof, which project beyond the glow wire in the direction of the anode, are also convexly arcuately shaped. Glow wire cathodes have a high evaporation rate of the material that emits the electrons during the operation of the x-ray tube, as a result of which the service life is limited. Moreover, the electron emission of an elongated (uncoiled) glow wire is relatively low.

U.S. Pat. No. 3,833,494 discloses a cathode for an electrical discharge tube that has a high electron emission and a long service life. This cathode is composed of a rhenium carrier on which a lanthanum hexaboride layer is applied and sintered in a cataphoretically. A pronounced formation of boride occurs, however, during the operation of the cathode which can lead to the rapid exhaustion and, thus, to the rupture of the rhenium carrier. The service life of this known cathode is consequently reduced.

U.S. Pat. No. 4,752,713 discloses a glow cathode for an electron tube having high emission capability. This glow cathode is composed of a heat-resistant, metallic or ceramic member serving as carrier and a metallic activation substance that promotes the electron emission. This activation substance is composed of an alloy of a group VIII metal and rhenium and an element from the group of Ba, Ca, La, Y, Gd, Ce, Th, U, or by an intermetallic compound of the same elements. This activation substance covers the entire surface of the carrier and may be, for example, a lanthanum and platinum alloy.

SUMMARY OF THE INVENTION

It is an object of the invention to provide an x-ray arrangement such that the x-radiation generated by an x-ray radiator contributes to imaging to a considerably higher degree than in known systems and wherein the cathode of the x-ray radiator has a long service life while providing a high electron emission.

This object is achieved in an x-ray arrangement constructed in accordance with the principles of the present invention having an x-ray radiator that comprises an elongated cathode for emitting an electron beam that is elongated in cross section, means for accelerating the electrons of the electron beam onto an anode for generating x-ray radiation, and wherein the cathode forms a geometrical member completely filled with electron-emitting material, and whereby the material of the cathode contains at least one element from the group of rare earths and at least one element from the group of precious metals or boron.

An advantage of the invention is that an elongated x-ray beam is thus emitted by the x-ray radiator, so that only a slight gating of the ray cone is required in order to obtain an elongated, slot-shaped ray beam. The proportion of generated x-rays that contributes to the imaging is thus considerably higher than in known systems. A cathode that forms a geometrical member completely filled with electron-emitting material can be easily manufactured by powder metallurgy techniques, and has a high electron emission particularly when the material of the cathode contains at least one element from the group of rare earths and at least one element from the group of precious metals or boron. The electron-emitting material preferably contains lanthanum, specifically $LaB_6$, or an alloy of lanthanum and platinum.

The geometrical member of the cathode is preferably composed of individual lanthanum-containing members joined to one another, which are individually driveable, so that the cross section of the elongated electron beam can be varied.

It is advantageous when the anode is elongated. The elongated electron beam thus is incident on an elongated anode, so that an elongated, narrow x-ray beam is obtained. The loadability of the x-ray radiator is increased as a result of better heat distribution.

A grating for controlling the emission of electrons is preferably provided between the cathode and the anode. This grating is preferably slot-shaped so that the elongated electron beam generated by the cathode can thus be limited by the grating.

If the grating is formed by individual grating segments that are directed from the cathode in the direction toward the anode and to which a respective control voltage can be applied, it is possible to locally limit or control the emission of electrons by applying a blocking voltage to individual grating segments. In the through-connected, i.e. non-blocking, condition, each grating segment gates a focused electron beam portion of the total electron beam generated by the cathode, this producing an x-ray cone when it is incident on the anode.

By superimposing the individual x-ray cones produced in this manner, it is possible that one point of an exposure subject would be irradiated from different locations of the anode. Irradiation of a subject point from different directions is undesirable since this is then no longer projected onto the radiation receiver as a point, but is projected distorted. Preferably the anode is therefore followed in the radiation propagation direction by a radiation grating that has individual shafts whose longitudinal axes are aligned perpendicularly to the longitudinal axis of the anode. After penetrating the shafts, the x-ray cones that are generated are gated such that a point of an exposure subject is projected onto the radiation receiver by only one x-ray cone. If an especially high loading of the x-ray radiator should be needed, the anode can be fashioned as a dish-shaped or cylindrical rotatory anode.

DESCRIPTION OF THE PREFERRED EMBODIMENTS

Figure 1:
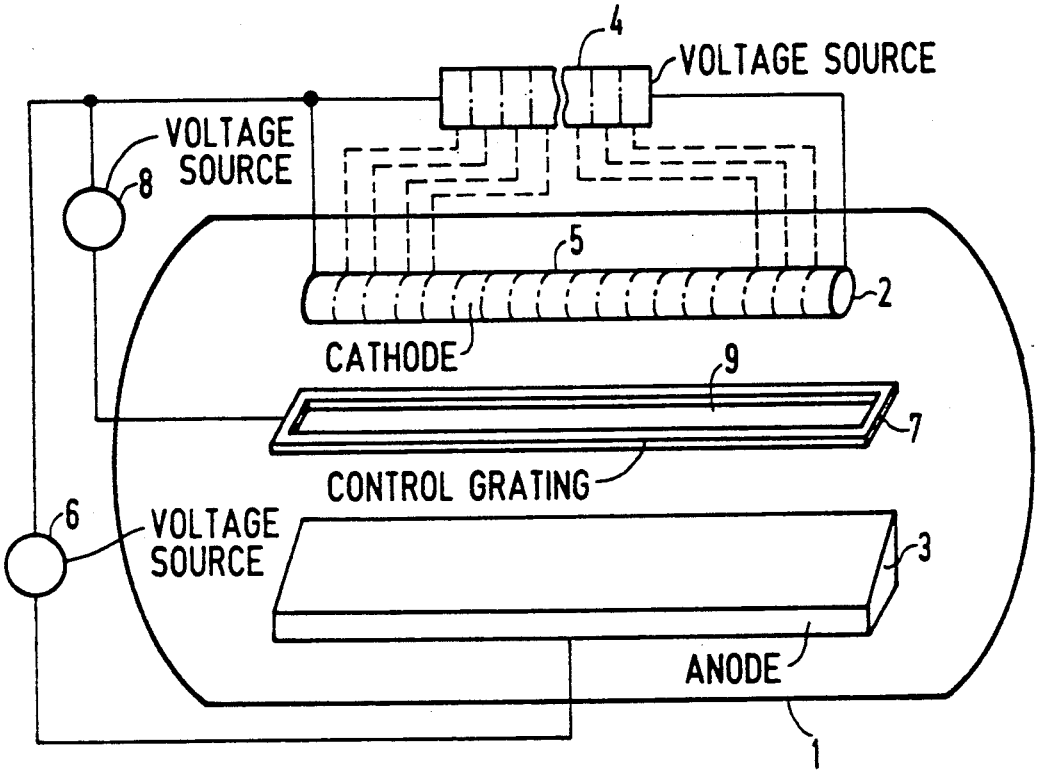
FIG. 1 is a schematic diagram of first embodiment of an x-ray radiator constructed in accordance with the principles of the present invention.

FIG. 1 shows an exemplary embodiment of an x-ray arrangement of the invention in the form of an x-ray radiator that has a glass member 1 in which a cathode 2 and an anode 3 are arranged. The cathode 2 is elongated in accord with the invention. The anode 3 of this exemplary embodiment is likewise elongated. The cathode 2 consists of a solid-state compound that contains La or a La-containing alloy, preferably $LaB_6$, as a constituent part of a material for emitting electrons, as a result whereof a higher emission current density is achieved in comparison to the conventional employment of tungsten at a given emission temperature. Moreover, the service life and the stability of the cathode 2 are enhanced. The same advantages are obtained if the cathode 2 consists of at least one element from the group of rare earths and at least one element from the group of precious metals, preferably $LaPt_x$, whereby x is preferably 1, 2 or 3, as a constituent part of a material for emitting electrons. The cathode 2 can be composed of a single, rod-shaped member or, may be composed of a plurality of members joined to one another, such as, for example, discs 5 of a La-containing compound of alloy such as $LaB_6$ or $LaPt_x$. These members can be particularly simply manufactured in powder metallurgy technology and by pressing. For emission of electrodes, the cathode 2 is to be brought to emission temperature, either by direct current flow or by the external application of heat. In the exemplary embodiment of FIG. 1, the cathode 2 is supplied with voltage from a voltage source 4, i.e. the cathode 2 is heated to emission temperature by direct current flow. When the cathode 2 is formed by a plurality of individual discs 5 of a La-containing compound of alloy such as $LaB_6$ or $LaPt_x$, then every individual disc 5 (as shown with broken lines) can be respectively supplied with a generatable voltage of the voltage source 4. As a result, it is possible to individually excite the discs 5 to emit electrons, so that the area of the cathode 2 that emits electrons can be varied.

For generating x-radiation, voltage from a further voltage source 6 can be applied to the cathode 2 and to the anode 3. The electrons emitted by the cathode 2 are thus accelerated onto the anode 3 where they convert their energy into heat and x-radiation. The cathode 2 thus emits an electron beam having an elongated cross section in the direction toward the anode 3.

Control of the emission of electrons can ensue with a grating 7 arranged between the cathode 2 and the anode 3 to which voltage from a third voltage source 8 can be applied. This grating 7, for example, can have a slot-shaped opening 9 with which the elongated electron beam can be limited.

Figure 2:
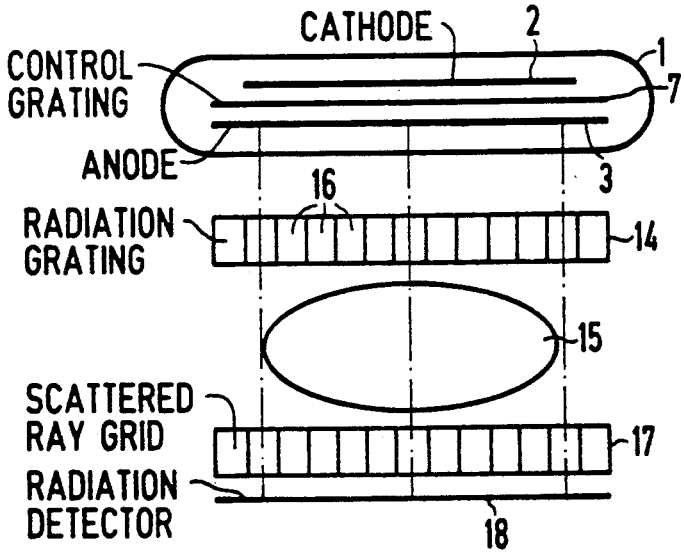
FIG. 2 is a schematic diagram showing the arrangement of an x-ray radiator of the type constructed in accordance with the principles of the present invention in relation to a patient and collimator grids.

FIG. 2 shows a schematic illustration of an x-ray arrangement of the invention, wherein the anode 3 of the x-ray radiator is followed by a ray grating 14 in the radiation propagation direction. This ray grating 14 has individual grating segments in the form of shafts 16, with the longitudinal axes of the shafts 16 are preferably aligned perpendicularly relative to the longitudinal axis of the anode 3. In the exemplary embodiment, the ray grating 14 is aligned parallel to the cathode 2 and to the anode 3 and is at least as long as the anode 3.

For producing an x-ray exposure, an examination subject 15 can be arranged between the ray grating 14 and a scattered ray grid 17 that is followed by a ray receiver 18. An elongated x-ray beam (dot-dash line) emitted by the anode 3 which, as already set forth, is composed of the individual, generated x-ray cones penetrates the individual shafts 16 and is incident on the examination subject 15. As a result of the shafts 16, this x-ray beam is subdivided into individual x-ray fans joined to one another, so that a subject region of the examination subject 15 is always transirradiated only by the x-ray fan lying closest to this subject region. The ray grating 14 thus prevents a subject region from being transirradiated from different directions, this being undesirable.

The scattered ray grid 17 that follows the examination subject 15 absorbs the scattered radiation produced in the examination subject 15 upon transirradiation of the examination subject 15.

Figure 3:
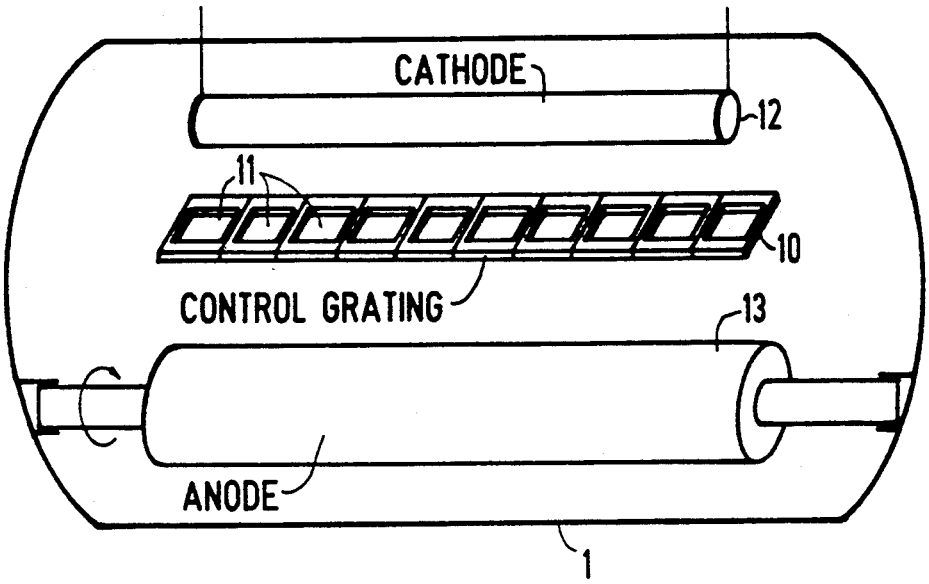
FIG. 3 is a schematic illustration of a further embodiment of an x-ray radiator constructed in accordance with the principles of the present invention.

A further exemplary embodiment of an x-ray arrangement of the invention comprising a second x-ray radiator is shown in FIG. 3. Elements that were already provided with reference numerals in FIG. 1 are given the same reference numerals. Differing from the exemplary embodiment of FIG. 1, the grating 10 has individual grating segments 11, which permit the electron beam emission and thus the x-ray beam emission to be locally controlled.

If the cathode 12 has only one elongated, rod-shaped element for emitting electrons, it is advantageous to apply a voltage for control and, if needed, for limiting the extent of the electron beam, to the individual grating segments 11. When, in conformity with the exemplary embodiment of FIG. 1, the cathode 12 has a plurality of individual discs of emitting material joined to one another, it is advantageous if one grating segment 11 is allocated to one or more discs.

Differing from the exemplary embodiment of FIG. 1, the anode 13 of FIG. 3 is cylindrical and is seated rotatable around its longitudinal axis. When this anode 13 rotates around its longitudinal axis while x-radiation is being generated, a better heat distribution is achieved, so that an x-ray radiator fashioned in this way can be more highly loaded.

The anode 13 can likewise be followed in radiation direction by a ray grid that was set forth in FIG. 2.

Figure 4:
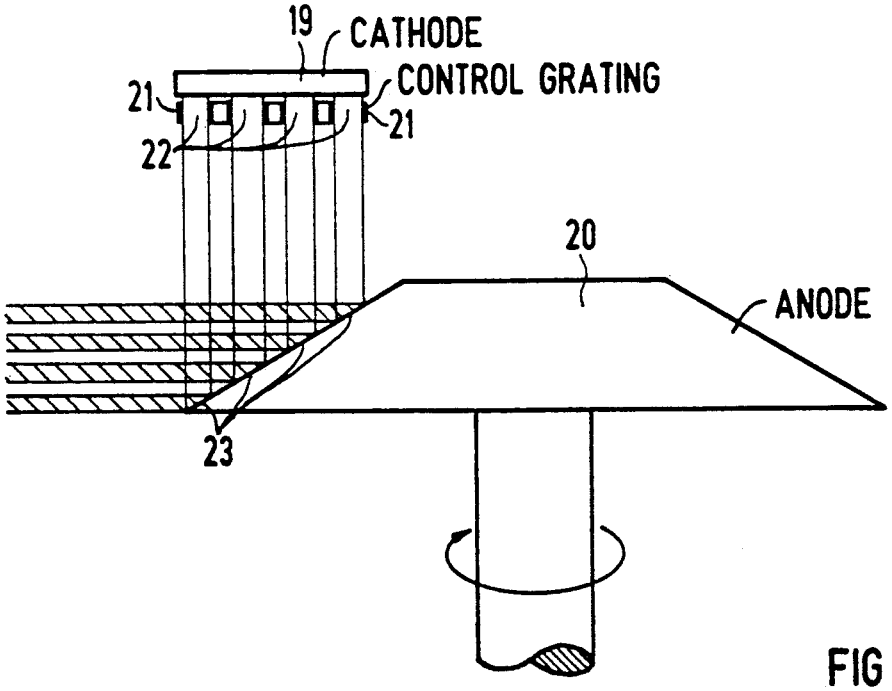
FIG. 4 is a schematic illustration of a portion of another embodiment of an x-ray radiator constructed in accordance with the principles of the present invention.

FIG. 4 shows an x-ray arrangement having an x-ray radiator that has an elongated cathode 19 for emitting electrons and that can be executed in conformity with the exemplary embodiments of FIGS. 1 and 3. A grating 21 that has individual grating segments 22 is provided for the control of the electrons, which are accelerated onto a rotatory anode 20. A voltage can be applied to the grating segments 22, so that the length of the emitted electron beam can be adjusted. It is shown in FIG. 4 that all grating segments 22 are switched "free", i.e. that the electron beam generated by the cathode 19 is not limited. By applying a blocking voltage to these grating segments 22, the extent of the electron beam can be set, for example, to one-half, whereby two grating segments 22 are connected to a blocking voltage, or can be set to one-fourth, whereby three grating segments 22 are connected to the blocking voltage. The extent of the focus 23 can be rapidly varied given this x-ray arrangement.

In the exemplary embodiment shown in FIG. 4, the focus 23, i.e. the region on which the electron radiation is incident on the rotatory anode 20, can also be topically varied if only one grating segment 22 permits passage of an electron beam. Of course, the cathode 19, the rotatory anode 20 and the grating 21 are fused in a vacuum member. A motor that places the rotatory anode 20 in rotation is not shown, nor are the terminals for the cathode 19, the grating 21 and the rotatory anode 20 required for voltage supply.

The x-ray arrangements of the invention are not limited to the exemplary embodiments shown in FIGS. 1 through 4. An x-ray arrangement of the invention may alternatively have an arcuate x-ray radiator, particularly if it is employed in computer tomography. Such an x-ray radiator for employment in a computer tomography surrounds the examination space that is provided for the exposure of an examination subject.

The cathode 2, 12 or 19 is particularly advantageous when it contains an element from the group of rare earths and an element from the group of precious metals, for example $LaPt_x$ or $LaB_6$ and is also permanently held at emission temperature during the stand-by mode of the x-ray tube, i.e. for a time of 5 minutes through 24 hours. Thermal stresses that are produced at the cathode 2, 12 or 19 given changing temperatures are thus avoided. Damage to the cathode 2, 12 or 19 due to these thermal stresses is thus effectively countered.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray radiator comprising:

an evacuated housing;

cathode means for generating an electron beam having an elongated cross section;

an anode;

means for accelerating the electrons in said electron beam from said cathode means onto said anode for generating x-rays; and said cathode means being formed by a geometrical member completely filled with electron-emitting material, said electron-emitting material containing at least one element from the group of rare earths and at least one element from the group of precious metals.

2. An x-ray radiator as claimed in claim 1 wherein said cathode means comprises a plurality of lanthanum-containing members connected to each other.

3. An x-ray radiator as claimed in claim 1 wherein said anode is elongated.

4. An x-ray radiator as claimed in claim 1 further comprising grating means for controlling the emission of said electron beam disposed between said cathode means and said anode.

5. An x-ray radiator as claimed in claim 4 wherein said grating means has a slot-shaped opening through which said electron beam passes.

6. An x-ray radiator as claimed in claim 4 wherein said grating means consists of a plurality of individual grating segments, and means for applying a respective control voltage to each segment for individually controlling electrons in said electron beam passing through said segment.

7. An x-ray radiator as claimed in claim 1 further comprising a radiation grating disposed in the direction of radiation propagation following said anode, said radiation grating having a plurality of individual shafts through which said radiation passes having longitudinal axes disposed perpendicular to a longitudinal axis of said anode.

8. An x-ray radiator as claimed in claim 1 wherein said anode is a rotary anode.

9. An x-ray radiator as claimed in claim 1 further comprising means for permanently holding said cathode means at an emission temperature.

10. An x-ray radiator comprising:

an evacuated housing;

cathode means for generating an electron beam having an elongated cross section;

an anode;

means for accelerating the electrons in said electron beam from said cathode means onto said anode for generating x-rays; and cathode means consisting of a plurality of individual emitter elements directly joined to each other side-by-side forming a geometrical member completely filled with electron-emitting material, said electron-emitting material containing at least one element from the group of rare earths and at least one element from the group of precious metals or boron.

11. An x-ray radiator as claimed in claim 10 wherein said cathode means contains $LaB_6$.

12. An x-ray radiator as claimed in claim 10 wherein said cathode means contains lanthanum and platinum.

13. An x-ray radiator as claimed in claim 10 further comprising:

voltage source means connected to each of said individual emitter elements for selectively driving individual emitter elements to emit electrons.

* * * * *